US005322732A

United States Patent [19]

Gilmour et al.

[11] Patent Number: 5,322,732

[45] Date of Patent: Jun. 21, 1994

[54] IMAGE TRANSPARENCIES

[75] Inventors: Hugh S. A. Gilmour; Timothy E. Neale, both of Rochester, N.Y.

[73] Assignee: Eastman Kodak Company, Rochester, N.Y.

[21] Appl. No.: 722,998

[22] Filed: Jun. 28, 1991

[51] Int. Cl.[5] ..... B41M 5/035; B41M 5/38

[52] U.S. Cl. ..... 428/332; 427/146; 427/152; 428/195; 428/913; 428/914; 503/227

[58] Field of Search ..... 8/471; 428/195, 913, 428/914; 503/227; 40/159.2; 427/146, 152

[56] References Cited

U.S. PATENT DOCUMENTS 4,054,916 10/1977 Knop ..... 358/284
4,197,583 4/1980 Westell et al. ..... 364/571
4,279,003 7/1981 Schulz ..... 358/280
4,536,803 8/1985 Hennig ..... 358/299
4,646,355 2/1987 Petrick et al. ..... 382/54
4,670,793 6/1987 Yamada et al. ..... 358/284

*Primary Examiner*—B. Hamilton Hess
*Attorney, Agent, or Firm*—Robert L. Randall

[57] ABSTRACT

An improved image transparency or slide is disclosed in which certain small image anomalies are rendered invisible to the human eye in an image projected from the slide. A diffusion layer spaced a finite distance from an image coating of the slide causes disappearance of the anomalies in a the projected image. In applications requiring particularly high sharpness, the image is formed on the slide using image enhancement techniques which produce exaggerated edge effects in the image. When these exaggerated edge effects are diffused in a projection, the projected image is sharp and free of the anomalies.

10 Claims, 3 Drawing Sheets

LIGHT DIFFUSION

LIGHT DIFFUSION
AND
IMAGE SHARPENING
DESIRED IMAGE
IMAGE SIGNAL
INITIAL IMAGE ON RECEIVER
IMAGE AFTER FUSION
PROJECTED IMAGE
40
400
41
402
42
404
43
44
406
45
46
408
47
50
500
51
502
52
504
53
54
506
55
56
508
60
600
62
602
61
62
64
604
65
606
608

IMAGE TRANSPARENCIES

CROSS REFERENCE TO RELATED PATENT APPLICATIONS

The present invention is related to two copending U.S. patent applications. The first related application Ser. No. 457,593, now U.S. Pat. No. 5,066,962, entitled "Thermal Printer" and has a common assignee with the present patent application. The second related application Ser. No. 722,788, is entitled "Apparatus and Method for Fusing an Image onto a Receiver Element".

FIELD OF THE INVENTION

This invention relates to an improved image transparency or slide and to a method for its preparation, and more particularly, to an improved slide which produces projected images free of anomalies.

BACKGROUND OF THE INVENTION

Images are often generated on transparencies or slides so that they can be projected onto a screen. Typically a projected image is magnified substantially relative to its original size on the slide. In many cases, an image is formed on a slide with undesired artifacts or anomalies. When these anomalies are magnified in a projection of the image, they lend a displeasing character to the projected image.

These anomalies are produced by various phenomena during the generation of an image on a slide. For example, a photographic emulsion may display its crystalline configuration. This type of anomaly is referred to as "graininess". Another type of image anomaly occurs when slide images are produced by a thermal printing process.

In thermal printing, computer generated image data is supplied to a modulated laser. The laser is used to transfer dye from a dye-donor film to a surface of a slide on which an image is desired. In the context of thermal printing, the slide is typically referred to as a receiver.

In one particular form of thermal printing the receiver is a transparency or slide in 35 mm format (i.e., 1 inch by 1.5 inch). A thermal printer that produces such slides is disclosed in U.S. patent application Ser. No. 457,593 (S. Sarraf), entitled "Thermal Printer" and referred to in the Related Patent Applications section hereinabove.

When slides are produced by thermal printing, a dye-donor film is used that contains spacer beads in a dye coating. These types of dye coatings are disclosed in U.S. Pat. No. 4,772,582, issued Sep. 20, 1988. The spacer beads are very small, typically eight to fifteen microns in diameter. However, as a laser passes over a spacer bead, a "shadow" of the bead (i.e., a spot with low dye density) is formed in the image. These shadows, if left intact, produce visible anomalies in an image that is projected onto a screen from such a slide.

It is desirable therefore to produce such slides so that these visible image anomalies are not present in projected images.

SUMMARY OF THE INVENTION

The present invention is directed to an improved image transparency or slide in which certain small image anomalies are rendered invisible in an image projected from the slide and to a method for the preparation thereof. A diffusion layer on the slide spaced a finite distance from an image coating of the slide causes disappearance of the anomalies in a projected image. In applications requiring particularly high resolution, the image is formed on the slide using image enhancement techniques which produce exaggerated edge effects in the image. When these exaggerated edge effects are diffused in a projection, the projected image is sharp and free of the anomalies.

Viewed from one aspect, the present invention is directed to an image transparency having undesired anomalies in an image coating thereon and a light diffusion layer formed thereon which is spaced a finite distance from the image coating.

Viewed from another aspect, the present invention is directed to a method for producing an image transparency. The method comprises the steps of producing an image coating on the transparency with exaggerated edge definition and applying a light diffusion medium to the transparency.

Viewed from still another aspect, the present invention is directed to a method for producing an image transparency from computer generated image data. The method comprises the steps of performing image sharpening on the image data, thermally printing an image on the transparency with the sharpened image data, and applying a light diffusion medium to the transparency.

The invention will be better understood from the following detailed description taken in consideration with the accompanying drawings and claims.

DETAILED DESCRIPTION OF THE DRAWINGS

The drawings are not necessarily to scale.

DETAILED DESCRIPTION OF THE INVENTION

Figure 1:
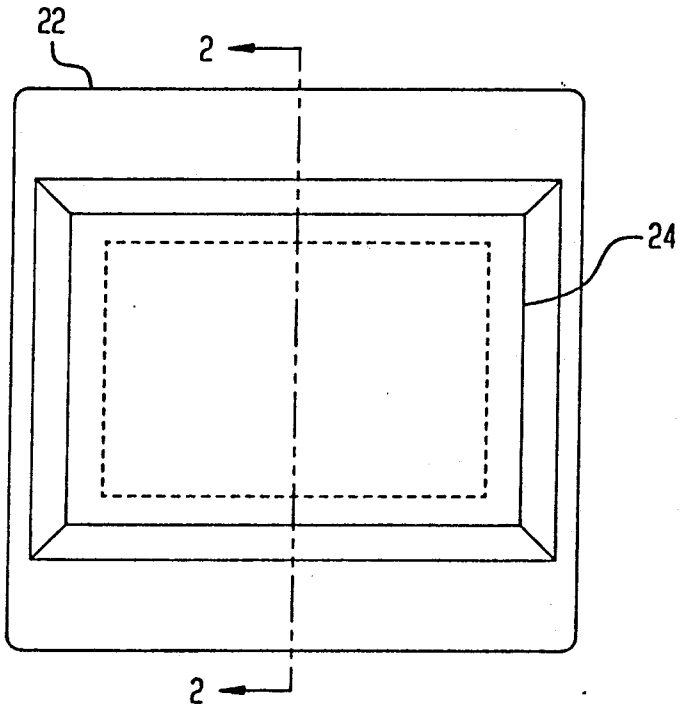
FIG. 1 is a view of an image transparency in accordance with the present invention.

Referring now to FIG. 1, there is shown a preferred embodiment of a transparency or slide 20 in accordance with the present invention. The slide 20 comprises a frame 22 and an image area 24. In the preferred embodiment, the frame 22 and the image area 24 are formed as a single unit from molded polycarbonate.

Figure 2:
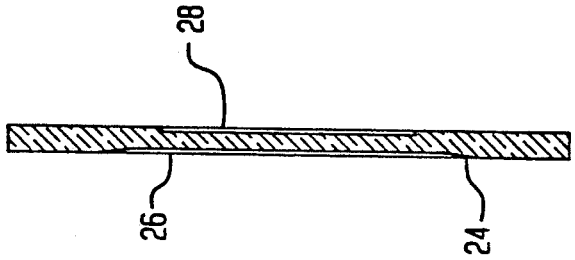
FIG. 2 is a cross-sectional view of the image transparency of FIG. 1 taken along a dashed line 2—2.

Referring now to FIG. 2, there is shown a cross-sectional view of the slide 20 taken along the line 2—2. FIG. 2 shows that the image area 24 of the slide 20 has an image coating 26 on a first side and a diffusion layer 28 on a second side thereof.

The image coating 26 is applied to the slide 20 in a thermal printing operation in which a modulated laser transfers dye from a dye-donor film to the image area of the slide 20. This technique for transferring dye is disclosed and claimed in U.S. patent application entitled "Thermal Printer" which is referred to in the Related Patent Applications section hereinabove and is incorporated herein.

In order to assure that a proper transferring of dye occurs during thermal printing, the dye-donor film is produced with a coating of dye that contains small spacer beads. Typically, these beads are about eight to fifteen microns in diameter. When images are formed from dye coatings that contain these beads, the image coating 26 develops anomalies. These anomalies manifest themselves as spots with low dye density. Typically the spots are the same size as the beads. In effect, these anomalies are shadows of the beads formed when a laser beam is used to transfer dye to the image area 24 of the slide 20.

Because these bead shadows are small, in the order of eight to fifteen microns, they are not always visible in images that have a complex subject matter even when the images are projected from the slide 20 at a magnification of 40× or more. However, if a large portion of an image is comprised of a single tone or color, the bead shadows become visible in a projection. In this latter case, the bead shadows constitute undesirable image anomalies.

It has been found that bead shadows can be substantially eliminated from an image that is projected from one of the slides 20 when the slide is provided with the diffusion layer 28.

Figure 3:
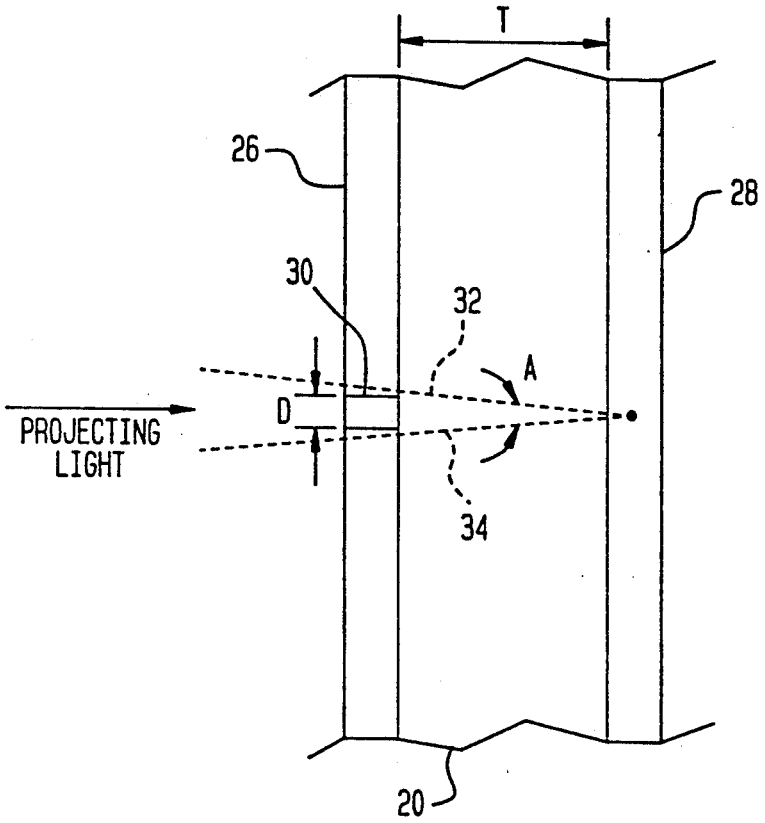
FIG. 3 is an enlarged partial cross-sectional view of the image transparency of FIG. 2.

Referring now to FIG. 3, there is shown an expanded view of a portion of the slide shown in FIG. 2. FIG. 3 shows a portion of the diffusion layer 28 and a portion of the image coating 26. Thickness of the image coating 26 and the diffusion layer 28 are exaggerated for purposes of clarity. A bead shadow 30 having a dimension D is shown in the image coating 26. In order to illustrate the effect of the diffusion layer 28, there are shown two converging dashed lines 32 and 34. The dashed lines 32 and 34 are symbolically representative of an effectiveness of the diffusion layer 28. The diffusion layer 28 is spaced a distance T from the image coating 26. When the slide 20 is placed in a projector (not shown), the image coating 26 becomes a desired plane of focus for the projector. Thus, the diffusion layer 28 is spaced the distance T from the plane of focus in the projector.

It is a well known principle of optics that a light diffuser has a characteristic light scattering envelope with a light scattering angle that is a function of the material from which the diffuser is made. The diverging lines 32 and 34 represent symbolically, the bounds of the light scattering envelope of the diffusion layer 28. The lines 32 and 34 diverge at an angle A. The angle A is representative of the inherent light scattering angle of the material which constitutes the diffusion layer 28.

The divergence of the lines 32 and 34 has a relationship to a degree of uncertainty of resolution of a projector in which the slide 20 is inserted. A lens system of a projector is unable to resolve any object on the image coating (the plane of focus of the projector) which is small enough to be included within the diverging lines 32 and 34. The size of such an object is a function of the scattering angle A of the diffusion layer 28 and the spacing between the diffusion layer 28 and the image coating 26, i.e., the slide thickness T. In other words, an object on the image coating 26 can be made to disappear in a projection if the scattering angle A and the distance T have a proper relationship to the size of the object.

In the case illustrated in FIG. 3, the bead shadow 30 is shown having a diameter D. Thus, for any slide having a thickness T, a diffusion layer is selected to have a light scattering angle A such that the following relationship obtains: $A = \text{Arctan } D/2T$.

When the uncertainty of resolution of a projected image of the slide 20 is larger than the bead shadow 30 in the image coating 26, the projection does not contain a projection of the bead shadow 30. In other words, the bead shadow 30 is effectively rendered invisible in the projection of the slide 20. It should be noted that the diffusion layer 28 must be displaced from the image coating 26 by a finite distance. If the diffusion layer 28 and the image coating 26 were merged together, the diffusion layer 28 would produce no effective resolution uncertainty in a projector. Consequently, the bead shadows would not be rendered invisible in a projected image.

Even though the diffusion layer 28 renders the bead shadow invisible in a projection, the diffusion layer causes an overall reduction in sharpness of the projected image. In order to minimize the deleterious effects on image sharpness, the diffusion layer 28 has characteristics which cause scattering of light only in a forward direction and with a relatively narrow cone around an axis of the incoming or undeflected beam.

In a preferred embodiment of the present invention, the slide has a thickness T that is about 3 mm. The angle A can be as small as about 0.1° in order that a projection uncertainty diverges the distance D within the thickness T of the slide 20. In other words, a light scattering angle of 0.1° produces a resolution uncertainty that is greater than the size of the bead shadow 30. It has been found that two layers of conventional three mil polyethylene is a suitable configuration for the diffusion layer 28. With this configuration the bead shadows 30 do not form visible projections at a 45× magnification. The projected image remains sharp enough so that a line pattern as fine as 22 lines/mm on the image coating 26 is visibly projected. This resolution is adequate to provide a good quality projected image at a 45× magnification. However, if a projection is desired at a higher magnification, then a higher resolution is desirable.

In practicing the present invention, it is possible to achieve a virtually undiminished sharpness of a projected image with the diffusion layer 28 in place on the slide 20. This is achieved by performing an image sharpening step prior to transferring dye to the image surface 24 of the slide 20 as explained hereinbelow.

Figures 4, 5, 6:
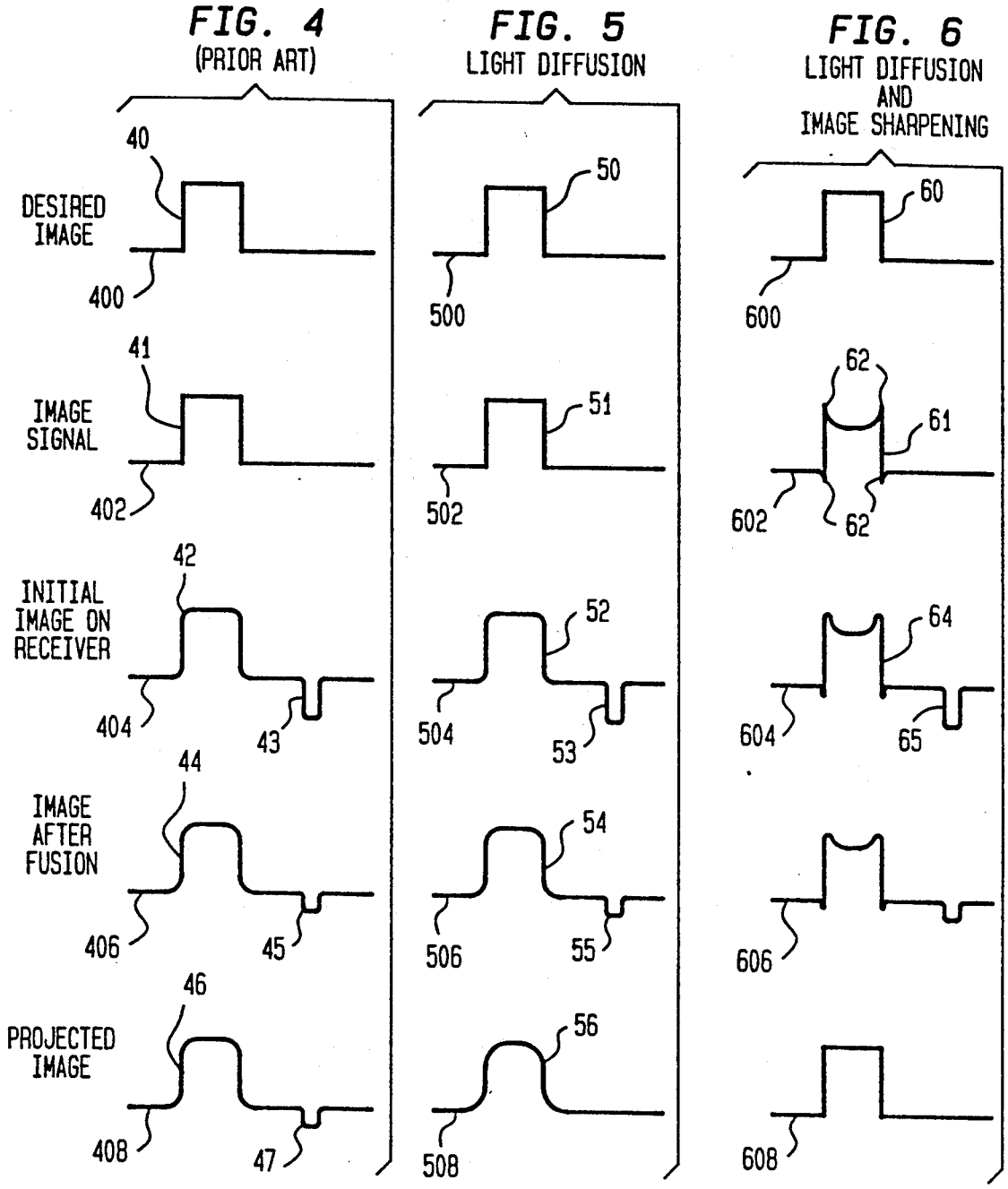
FIG. 4 (PRIOR ART)
FIG. 4 is series of graphs that illustrate the prior art.
FIG. 5 is a series of graphs that illustrate a light diffusion aspect of the present invention.
FIG. 6 is a series of graphs that illustrate an image sharpening aspect of the present invention combined with the diffusion aspect that is illustrated in FIG. 5.

Referring now to FIGS. 4, 5 and 6, there is shown a series of graphs that illustrate various aspects of the present invention and the prior art.

Referring now specifically to FIG. 4, there is shown a series of graphs, 400, 402, 404, 406, and 408, that demonstrate various stages in a formation of an image on a slide in accordance with the prior art. The graph 400 shows a hypothetical portion of a desired image with image density shown on vertical axis and distance along an image on a horizontal axis. A desired image is shown as a simple square wave 40 on the graph 400. A graph 402 shows a corresponding signal that is transmitted to a thermal printer to produce the desired image of graph 400. In graph 402, laser power is shown on a vertical axis and distance along an image is shown on a horizontal axis. The signal in graph 402 is shown as a simple square wave 41. A graph 404 shows a corresponding initial image on a receiver that is produced when a laser operates in accordance with graph 402. In graph 404 optical density of dye is shown on a vertical axis and distance along an image is shown on a horizontal axis. Graph 404 comprises a desired image portion 42 and a bead shadow portion 43. The desired image portion of the graph 404 is a slightly rounded version of the square wave 41 of the graph 402. This slight rounding is characteristic of thermal printing and is caused by lateral diffusion of dye during transfer. The bead shadow portion 43 is generated by the laser as it traverses over one of the spacer beads in the dye coating. In graph 404, the bead shadow portion 43 is shown as an area of an image with a particularly low optical density. This is, of course, consistent with a virtual absence of dye at the location of the bead shadow.

The graph 406 has a desired image portion 44 and a bead shadow portion 45 each corresponding to the portions 42 and 43 respectively, of the graph 404. Graph 406 shows optical density of dye on a receiver after the receiver has been subjected to a fusing operation. A system of fusing dye into the image surface 26 of the slide 20 is disclosed and claimed in a U.S. patent application entitled "Apparatus and Method for Fusing an Image onto a Receiver Element" which is described in the Related Patent Applications section hereinabove and is incorporated herein. The fusing operation results in the portion 44 appearing as a further rounded version of the portion 42 of graph 404. This is because the fusing operation causes a chemical diffusion of the dye into and across the image surface 26. The bead shadow portion 45 of the graph 406 has a smaller magnitude than the bead shadow portion 43 of the graph 404. This is because the fusing operation causes dye to fill in the bead shadow from all sides of the shadow. Consequently, the bead shadow is substantially reduced in the fusing operation.

The graph 408 has a portion 46 and a portion 47 which correspond to the portions 44 and 45 of the graph 406, respectively. Graph 408 shows optical density of an image projected from the slide 20 which has an image thereon that corresponds to the graph 406. The graph 408 has the same shape as the graph 406.

Referring now to FIG. 5, there is shown a series of graphs 500, 502, 504, 506 and 508 which illustrate the effects of the diffusion layer 28 in accordance with the present invention. The graph 500 shows a square wave 50 that represents the same desired image as the square wave 40 in FIG. 4. The graph 502 shows an image signal square wave 51 which is the same as the square wave 41 of FIG. 4. Similarly, the graph 504 shows a desired image portion 52 and a bead shadow portion 53 which are the same as the portions 42 and 43 of FIG. 4. The graph 506 shows a desired image portion 54 and a bead shadow portion 55 which are the same as the portions 44 and 45, respectively of FIG. 4. Graph 508 has a projected image portion 56 that is shaped to a more rounded configuration than the projected image portion 46 of FIG. 4. The additional rounding results from the effects of the diffusion layer 28 of FIG. 2. It should be noted that the graph 508 does not show any bead shadow portion. The bead shadow of the graph 506 is rendered invisible in the projected image by the diffusion layer 28.

Referring now to FIG. 6, there is shown a series of graphs 600, 602, 604, 606 and 608 which illustrate the effects of image sharpening combined with a diffusion layer in accordance with the present invention. The graph 600 shows a square wave 60 that represents the same desired image as the square wave 50 in FIG. 5. The graph 602 shows a signal wave form 61 that is used to program a thermal printer to produce the desired image square wave 60 of the graph 600. The wave form 61 is generally a square wave but with substantial intentional distortions 62 introduced at its corners. The distortions 62 are produced in accordance with conventional image enhancement or sharpening techniques. Such techniques are described in various treatises on image processing, for example see Hall, Ernest H., "Computer Image Processing and Recognition", Academic Press, New York, N.Y. (1979) pp. 202–205.

Graph 604 represents an image formed on a receiver by a thermal printer that is programmed with the signal of graph 602. Graph 604 has a desired image portion 64 and a bead shadow portion 65. The portion 64 shows that the optical density of dye on the receiver is exaggerated at the edges of the image, but the degree of exaggeration is reduced relative to the level of exaggeration in the signal of graph 602. This . reduction is a result of the conventional characteristics of thermal printing. Graph 606 shows that after fusing the exaggerations of edges of the image are reduced even further, but are nevertheless present.

The graph 608 shows a resultant projected image from one of the slides 20 which has one of the diffusion layers 28 formed thereon. It can be seen that the diffusion layer further reduces the exaggeration of the edges which are evident in the graph 606. Indeed, the reduction of exaggeration is sufficient to make the exaggerations disappear entirely. Additionally, the diffusion layer 28 produces a projected image with no bead shadow.

It is to appreciated and understood that the specific embodiments of the invention are merely illustrative of the general principles of the invention. Various modifications may be made by those skilled in the art which are consistent with the principles set forth. For example, slides with images produced by conventional photographic techniques can be improved by using the inventive concepts described herein. Additionally, slides can be produced with image coatings separated from diffusion layers by air gaps.

What is claimed is:

1. An image transparency having an image coating thereon and a light diffusion layer spaced a finite distance from the image coating, said diffusion layer obviating anomalies in an image formed in said image coating in an image projected by light passing first through said image coating and then through said diffusion layer, said diffusion layer causing scattering of light with a relatively narrow cone around an axis of said light.

2. The image transparency of claim 1 wherein the diffusion layer produces scattering of light at an angle A which is given by the expression $A = \text{Arctan } D/2T$, where D is a dimension of one of the anomalies and T is a distance between the diffusion layer and the image coating.

3. The image transparency of claim 1 wherein an image in the image coating has exaggerated edge definition.

4. The image transparency of claim 1 wherein:
the image coating is formed on a first side of the transparency; and
the diffusion layer is formed on a second side of the transparency.

5. The image transparency of claim 4 wherein:
the anomalies are about 8 microns or larger;
the first and second sides of the transparency are separated by a distance of about 3 mm or less; and
the diffusion layer has a light scattering angle of about 0.1° or less.

6. An image transparency having an image coating thereon and a light diffusion layer thereon spaced a finite distance from the image coating, the diffusion layer having a light scattering angle of 0.1° degree or less and being separated from the image coating by less than 3 mm, and the diffusion layer obviating anomalies in an image formed in the image coating in an image projected by light passing through the image coating and then through the diffusion layer.

7. A method for producing an image transparency comprising the steps of:

producing an image coating on the transparency with exaggerated edge definition; and applying a light diffusion medium to the transparency on the downstream side of said image coating with respect to light directed toward said image coating to project an image formed therein, said light diffusion medium causing scattering of light with a relatively narrow cone around an axis of said light.

8. The method of claim 7 wherein the exaggerated edge definition and the degree of diffusion produced by the diffusion medium result in a projected image from the transparency having substantially the same sharpness as a projected image produced without exaggerated edge definition.

9. A method for producing an image transparency according to claim 7 including the steps of:

producing an image in the image coating from computer generated image data;

performing image sharpening on the image data; and thermally printing an image on the transparency with the sharpened image data.

10. The method of claim 9 wherein the sharpening of the image data and the degree of diffusion produced by the diffusion medium result in a projected image from the transparency that has substantially the same sharpness as a projected image produced by unsharpened image data.

* * * * *